US006758043B2

(12) United States Patent
Michau et al.

(10) Patent No.: US 6,758,043 B2
(45) Date of Patent: Jul. 6, 2004

(54) TURBOMACHINE INJECTORS

(75) Inventors: Marion Michau, Vincennes (FR); José Rodrigues, Nandy (FR); Alain Tiepel, Chailly en Biere (FR)

(73) Assignee: Hispano-Suiza, Colombes (FR)

( * ) Notice: Subject to any disclaimer, the term of this patent is extended or adjusted under 35 U.S.C. 154(b) by 59 days.

(21) Appl. No.: 10/298,905

(22) Filed: Nov. 19, 2002

(65) Prior Publication Data

US 2003/0093998 A1 May 22, 2003

(30) Foreign Application Priority Data

Nov. 20, 2001 (FR) ..... 01 14973

(51) Int. Cl.[7] ..... F02C 1/00; F02G 3/00

(52) U.S. Cl. ..... 60/740; 137/118.06; 60/741; 239/416

(58) Field of Search ..... 60/740, 741, 742, 60/746, 39.463; 239/402, 412, 413, 416, 416.4, 416.5; 137/118.06, 506

(56) References Cited

U.S. PATENT DOCUMENTS

| | | | | |
|---|---|---|---|---|
| 3,662,959 A | | 5/1972 | Sample, Jr. | |
| 3,726,325 A | * | 4/1973 | Munz | 141/317 |
| 4,476,675 A | | 10/1984 | Aurousseau et al. | |
| 4,491,272 A | | 1/1985 | Bradley et al. | |
| 4,570,668 A | | 2/1986 | Burke et al. | |
| 4,987,878 A | * | 1/1991 | Johnson | 123/531 |
| 5,048,497 A | * | 9/1991 | Kishida et al. | 123/533 |
| 5,353,991 A | * | 10/1994 | De Nagel et al. | 239/409 |
| 5,730,369 A | * | 3/1998 | De Nagel et al. | 239/585.4 |
| 5,732,730 A | | 3/1998 | Shoemaker et al. | |
| 6,178,951 B1 | * | 1/2001 | Doreau et al. | 123/495 |
| 6,644,031 B2 | * | 11/2003 | Lavie et al. | 60/740 |
| 6,676,030 B2 | * | 1/2004 | Lorraine et al. | 239/5 |

FOREIGN PATENT DOCUMENTS

GB 2 250 086 5/1992

* cited by examiner

*Primary Examiner*—Justine R. Yu
*Assistant Examiner*—William H. Rodriguez
(74) *Attorney, Agent, or Firm*—Oblon, Spivak, McClelland, Maier & Neustadt, P.C.

(57) ABSTRACT

A fuel injector for a turbomachine engine, the injector comprising an injector body having pressurized fuel admission means, a first valve mounted downstream from the pressurized fuel admission means and arranged to admit fuel into the injector body, a second valve mounted downstream from the first valve and capable of opening in order to meter at least a fraction of the fuel admitted into the injector body for utilization means for using the fuel, the metered fuel flow rate to the utilization means being a function of flow sections formed through the second valve, the injector further comprising a diaphragm placed between the pressurized fuel admission means and the first valve so as to set the rate at which fuel is admitted into the injector body at a determined value.

5 Claims, 2 Drawing Sheets

TURBOMACHINE INJECTORS

BACKGROUND OF THE INVENTION

The present invention relates to improvements applied to fuel injectors for a turbomachine engine. More particularly the invention relates to adjusting the rate at which fuel is injected into a turbomachine combustion chamber.

In conventional manner, a turbomachine engine comprises a plurality of injectors enabling the combustion chamber to be fed with fuel and air during starting and normal operation of the turbomachine engine. There exists two main types of injector: "aeromechanical" injectors designed for two fuel flow rates (a primary rate and a secondary rate) depending on the operating stage of the engine (lighting, from low to full power), and "aerodynamic" injectors which have a single fuel circuit for all operating stages. The present invention relates more particularly to injectors of the first category.

In conventional manner, an aeromechanical fuel injector for a turbomachine engine comprises two fuel feed circuits: a primary circuit corresponding to low feed rates (for use, for example, during a lighting stage and when the engine is operating at low power), and a secondary circuit which comes into action for medium and high rates of flow (for use, for example, at subsequent stages of operation all the way to full power).

That type of injector includes in particular a stop valve which is designed to open at a first predetermined fuel feed pressure and to remain open at higher pressures in order to feed the primary fuel circuit. A metering valve is also arranged to open under a second predetermined feed pressure higher than the first predetermined pressure and to remain open in response to any increase in said pressure, serving to supply the fuel feed flow of the secondary circuit. The secondary flow rate is adjusted by means of metering slots provided in a valve head and providing flow sections that vary as a function of the applied feed pressure: the higher the applied pressure, the larger the flow sections of the slots.

In practice, it is found that in a combustion chamber fed with fuel via a plurality of injectors of the kind described above, when the injectors are all subjected to the same feed pressure corresponding to medium flow rates, they deliver flow rates that are not uniform from one injector to another. This non-uniformity is due mainly to manufacturing dispersions between their respective metering valves, and it can be as great as 10%. The manufacturing or machining tolerances on the metering valves and their metering slots mean that the medium rates of fuel flow cannot be made to be identical for all of the injectors of a given engine. FIG. 3 shows clearly the flow rate differences $\Delta D1$ and $\Delta D2$ that can exist in two different injectors 100 and 102 belonging to the same combustion chamber as compared with the design "ideal" rate 104. At medium rates of flow this gives rise to non-uniformity between injectors which is harmful for proper operations of the turbomachine engine.

OBJECT AND SUMMARY OF THE INVENTION

The present invention thus seeks to mitigate such drawbacks by proposing a fuel injector which enables non-uniformity between injectors to be decreased. Another object of the invention is to propose an injector that is simpler to make and to improve the adjustment performance at medium rates of fuel flow.

To this end, the invention provides a fuel injector for a turbomachine engine, the injector comprising an injector body having pressurized fuel admission means, a first valve mounted downstream from said pressurized fuel admission means and arranged to open in response to a predetermined fuel pressure defining a first threshold pressure so as to admit fuel into the injector body, a second valve mounted downstream from said first valve and capable of opening in response to a second fuel threshold pressure higher than said first threshold pressure so as to meter at least a fraction of the fuel admitted into said injector body for utilization means for using said fuel, the metered fuel flow rate to the utilization means being a function of flow sections formed through said second valve, the injector further comprising a diaphragm placed between the pressurized fuel admission means and the first valve so as to set the rate at which fuel is admitted into the injector body at a determined value.

The rate at which fuel is admitted into the injector body is a function in particular of the diaphragm. It is fixed at a determined value by selecting a diaphragm opening as a function of technical characteristics that are specific to each injector in the same combustion chamber. More precisely, the diaphragm selected for each injector is chosen as a function of the departure of its flow rate from a design medium flow rate. Thus, each injector in a given combustion chamber is provided with a diaphragm which may differ from one injector to another. As a result, any risk of the various injectors delivering different flow rates is eliminated. In addition, it is easy to replace a diaphragm since it does not require both valves to be disassembled.

Advantageously, the injector further comprises adjustment means for defining a third fuel threshold pressure higher than said second threshold pressure, from which the metered flow of fuel to said utilization means takes place at a rate which is a function solely of the fuel feed pressure.

The adjustment means for defining a third fuel threshold pressure advantageously comprise an abutment for limiting the stroke of the second fuel metering valve.

BRIEF DESCRIPTION OF THE DRAWINGS

Other characteristics and advantages of the present invention appear from the following description made with reference to the accompanying drawings which show an embodiment having no limiting character. In the figures.

DETAILED DESCRIPTION OF AN EMBODIMENT

Figure 1:
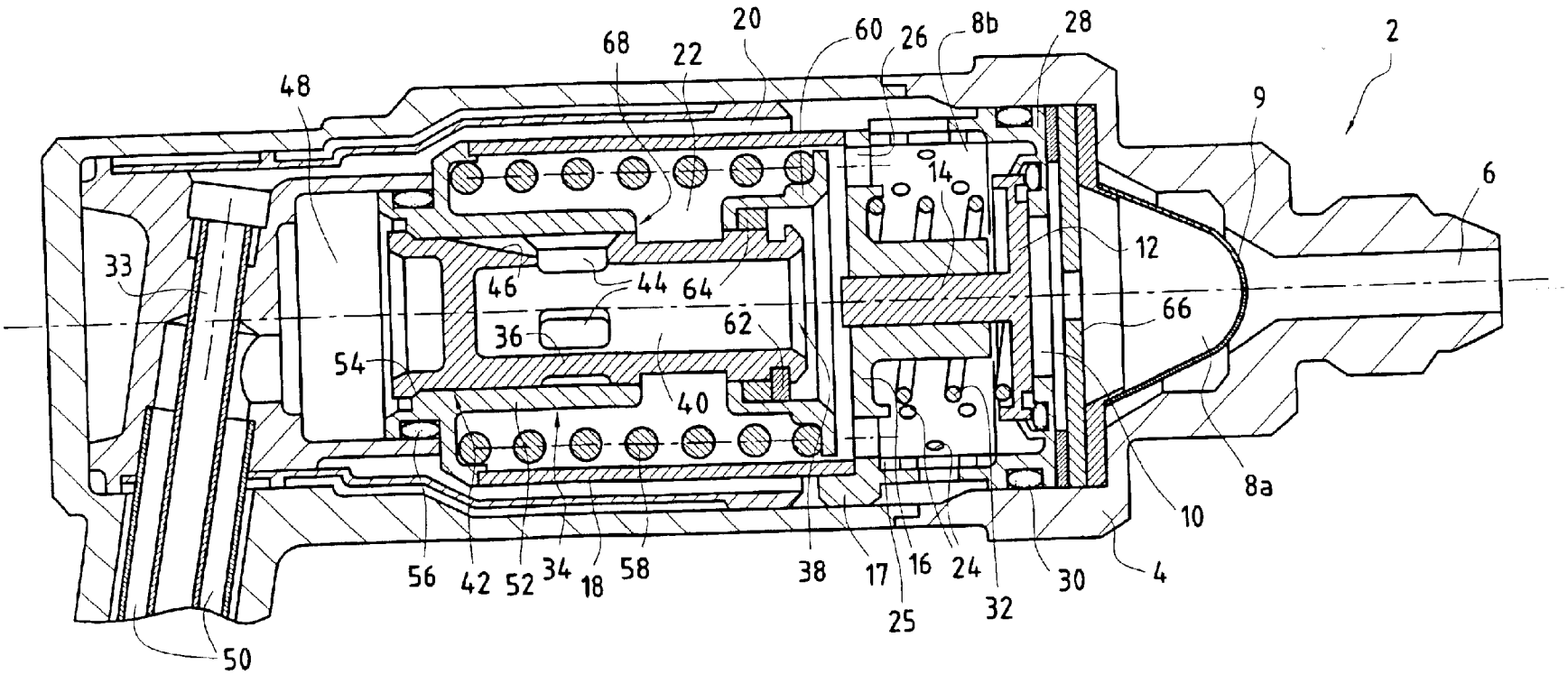
FIG. 1 is a longitudinal section view of a turbomachine fuel injector of the invention.

Reference is made to FIG. 1 which is a longitudinal section through a fuel injector of the invention for a turbomachine engine.

This injector is of the aeromechanical type, i.e. it is designed to deliver two fuel flows: a primary flow during a stage of starting the turbomachine fitted with this injector and a stage of operating at low power; and a secondary flow for subsequent stages of operation up to full power.

In the invention, the fuel injector 2 comprises an injector body 4 containing a fuel admission orifice 6 for receiving fuel under pressure from a suitable pump (not shown) and opening out into a pre-admission chamber 8*a* after passing through strainer type filter means 9. A sealing valve 10 for sealing of the injector when not in operation is mounted in an admission chamber 8*b* disposed downstream from the pre-admission chamber 8*a* in the fuel flow direction. It is conventionally formed by a valve head 12 and a valve stem 14 and it is held in position by means of a tubular central portion 16 forming a valve support. The tubular central portion 16 also rests via a cylindrical shoulder 17 against a first end of a cylindrical peripheral portion 18 which extends downstream from the central portion over a large fraction of the remaining inside volume of the injector body 4 and which defines an annular primary fuel chamber 20 and an annular secondary fuel chamber 22.

The primary annular fuel chamber 20 communicates with the admission chamber 8*b* via a plurality of side holes 24 and through a strainer 25 defining fixed flow sections. The secondary annular fuel chamber 22 is connected to the admission chamber 8*b* through longitudinal bores 26 pierced regularly through the cylindrical shoulder 17 of the valve support 16. The seat of the sealing valve 10 is formed by a rim of a cylindrical jacket 28 resting on the cylindrical shoulder 17 of the tubular central portion 16 and held in the injector body 4 in leaktight manner via sealing means 30 of the gasket type. A helical spring 32 is disposed between the valve supporting 16 and the valve head 12 to enable a predetermined fuel feed pressure to be set that defines a first threshold pressure S1 above which the sealing valve 10 opens. The fuel present in the pre-admission chamber 8*a* then penetrates into the admission chamber 8*b* and flows into the primary annular fuel chamber 20 through the side holes 24 before being delivered to a central primary fuel ejection channel 33 defining first means for utilizing the fuel.

A fuel metering device 34 is also mounted directly in the secondary annular fuel chamber 22 so as to meter the fuel flowing form said chamber. It conventionally comprises a metering valve 36 of tubular shape provided at a first end with an opening 38 opening out into a longitudinal secondary fuel admission bore 40, and at a second end that forms an end wall, it is provided with a substantially circular shoulder forming a valve head 42 and supporting a second end of the cylindrical peripheral portion 18. The metering valve 36 also has side outlets 44 through which the secondary fuel flows. The valve head 42 has fuel metering slots 46 around its periphery opening out into the longitudinal bore 40 and defining variable flow sections leading to second means for utilizing the fuel. These slots 46 are shaped very accurately so as to meter the quantity of fuel that flows from the secondary annular fuel chamber 22 to a reception chamber 48 formed in the injector body 4 and opening out to an annular secondary fuel ejection channel 50 surrounding the central primary fuel ejection channel 33.

The metering valve 36 is slidable in a cylindrical bushing 52 having a circular recess 54 at one end to form a valve seat. This bushing is held against the cylindrical peripheral portion 18 in leaktight manner by sealing means 56 of the gasket type. The bushing 52 also forms a bearing surface for one end of a helical spring 58 whose opposite end is mounted in an annular retaining element 60 engaged on the first end of the metering valve 36 and fixed thereto by means of a C-shaped clip 62. An annular spacer 64 is disposed between the clip 62 and the annular retaining element 60 so as to adjust the loading of the spring 58 and define a second threshold pressure S2 higher than the first threshold pressure S1 at which the metering valve 36 opens. This spring loading is selected in such a manner as to enable the metering valve to open at the second threshold pressure S2 and to remain open in response to an increase in the feed pressure, with the flow rate delivered then being a function of the flow sections of the metering slots 46.

The injector 2 is also provided with a diaphragm 66 disposed between the admission orifice 6 and the sealing valve 10. More precisely, the diaphragm 66 is mounted in the pre-admission chamber 8*a* upstream in the fuel flow direction from the cylindrical jacket 28 resting on the cylindrical peripheral portion 18. This diaphragm enables the rate at which fuel is admitted into the admission chamber 8*b* to be set at a determined value. The opening of the diaphragm is selected as a function of the characteristics specific to the injector (manufacture and machining of the metering valve and its slots, spring tension, friction effects between the valve and the bushing in which it slides, . . . ) and depending on how far its flow rate departs from a design medium flow rate. This selection is therefore performed in such a manner that the curve representing medium flow rates as a function of fuel feed pressure does not depart from a pre-established tolerance envelope. This tolerance envelope is pre-established as a function of a design ideal mean flow rate curve. For example, it may be defined in terms of flow rate departing by a maximum of about ±5% from the ideal medium flow rate curve.

According to an advantageous characteristic of the invention, the fuel injector further comprises adjustment means for defining a third threshold fuel pressure S3 higher than the second threshold pressure S2, above which the metered fuel flow rate to the second utilization means is a function solely of the fuel feed pressure. These adjustment means are in the form of an abutment 68, e.g. mounted in the bushing 52 so as to co-operate with the annular retaining element 60 so as to limit the stroke of the metering valve 36. This abutment 68 is adjusted for a predetermined fuel pressure corresponding to a flow rate close to fully open. It is also possible to envisage mounting a ring (not shown) on the first end of the metering valve 36, this ring also serving to limit the stroke of the metering valve.

Figure 2:
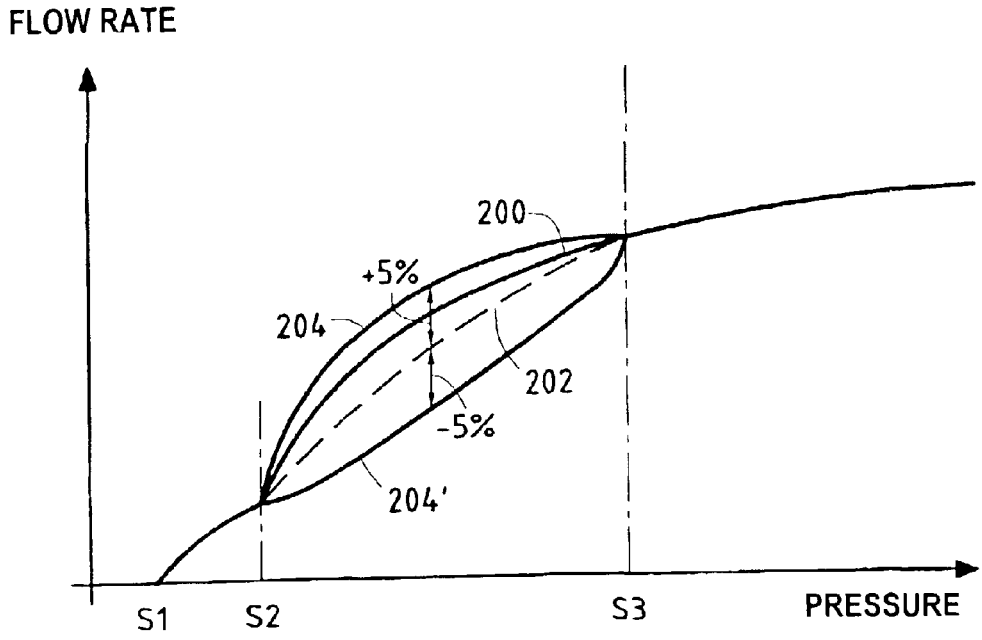
FIG. 2 is a graph showing an example of how injection flow rate in a turbomachine is adjusted when implementing the injector FIG. 1.
Figure 3:
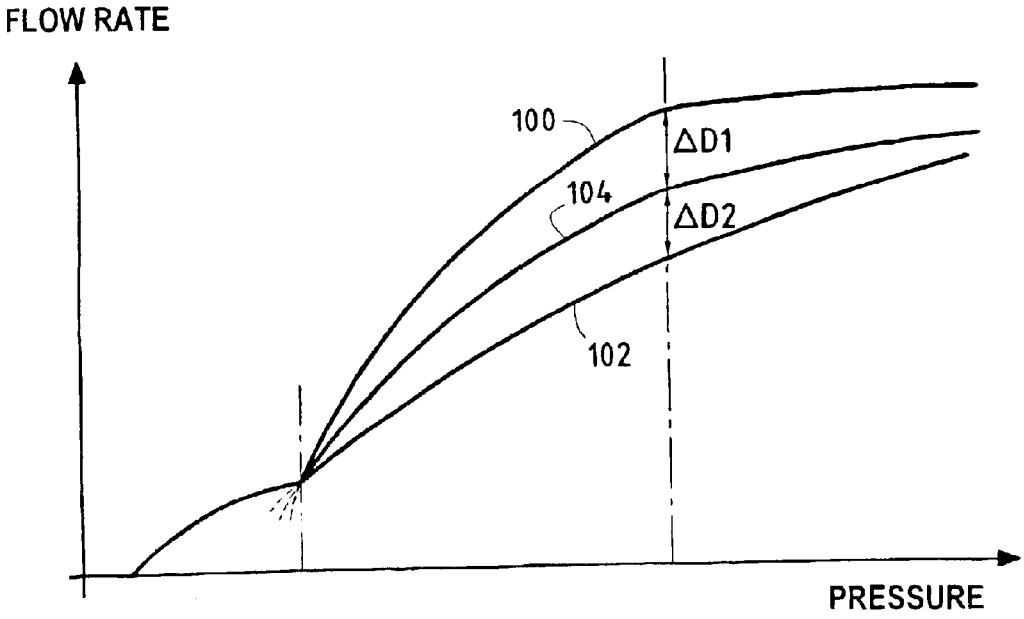
FIG. 3 is a graph showing an example of the differences in injection flow rate adjustment that can exist in a prior art turbomachine.

FIG. 2 shows clearly the effect of the diaphragm 66 on the departures that can exist at medium flow rates for one injector 200 of a combustion chamber compared with a design flow rate curve 202. In this figure, two curves 204 and 204' are also shown. These curves constitute a tolerance envelope beyond which flow rate departures from the ideal medium flow rate curve 202 are considered as being excessive. For this tolerance envelope, the maximum flow rate difference retained is ±5%. Thus, the presence of the diaphragm 66 makes it possible to reduce quite considerably the non-uniformity between the medium flow rates of a plurality of injectors in the same combustion chamber. Furthermore, above the third threshold pressure S3, the fuel flow rate is no longer a function of the machining characteristics of the spring and the slots, or of friction involving the injector valve, but only of the fuel feed pressure and the flow section of the valve which is against its abutment. Above this third threshold pressure S2, the metering valve thus behaves like a fixed diaphragm.

What is claimed is:

1. A fuel injector for a turbomachine engine, the injector comprising an injector body having pressurized fuel admission means, a first valve mounted downstream from said pressurized fuel admission means and arranged to open in response to a predetermined fuel pressure defining a first threshold pressure so as to admit fuel into the injector body, a second valve mounted downstream from said first valve and capable of opening in response to a second fuel threshold pressure higher than said first threshold pressure so as to meter at least a fraction of the fuel admitted into said injector body for utilization means for using said fuel, the metered fuel flow rate to the utilization means being a function of flow sections formed through said second valve, the injector further comprising a diaphragm placed between the pressurized fuel admission means and the first valve so as to set the rate at which fuel is admitted into the injector body at a determined value.

2. An injector according to claim 1, further comprising adjustment means for defining a third fuel threshold pressure higher than said second threshold pressure, from which the metered flow of fuel to said utilization means takes place at a rate which is a function solely of the fuel feed pressure.

3. An injector according to claim 2, wherein said adjustment means comprise an abutment for limiting the stroke of said second fuel metering valve.

4. A fuel injector for a turbomachine engine, the injector comprising an injector body having:

pressurized fuel admission means;

a first valve mounted downstream from said pressurized fuel admission means and arranged to open in response to a predetermined fuel pressure defining a first pressure threshold so as to admit fuel into the injector body and deliver it to first utilization means, the rate at which fuel is delivered being a function of flow sections formed through said first valve;

a second valve mounted downstream from said first valve and capable of opening in response to a second fuel threshold pressure higher than said first threshold pressure, so as to meter at least a fraction of the fuel admitted into said injector body leading to second utilization means for said fuel, the flow of fuel metered to the second utilization means being at a rate which is a function of flow sections formed through said second valve; and adjustment means for defining a third fuel threshold pressure higher than said second threshold pressure, from which the metered flow of fuel to said second utilization means takes place at a rate which is a function solely of the feed pressure of the fuel;

the injector further comprising a diaphragm disposed between the pressurized fuel admission means and the first valve so as to fix the rate at which fuel is admitted into the injector body at a determined value.

5. An injector according to claim 4, wherein said adjustment means include an abutment for limiting the stroke of said second fuel metering valve.

* * * * *